US005529540A

United States Patent [19]

Rozek

[11] Patent Number: 5,529,540

[45] Date of Patent: Jun. 25, 1996

[54] BILLIARD BALL RACK INCORPORATING A DISPLAY AREA

[75] Inventor: Christopher Rozek, Delafield, Wis.

[73] Assignee: KCS Industries, Milwaukee, Wis.

[21] Appl. No.: 423,977

[22] Filed: Apr. 18, 1995

[51] Int. Cl.[6] ..... A63D 15/00

[52] U.S. Cl. ..... 473/40

[58] Field of Search ..... 473/21, 26, 40, 473/41; 273/72

[56] References Cited

U.S. PATENT DOCUMENTS

| | | | |
|---|---|---|---|
| 1,260,540 | 3/1918 | Hogue | 473/41 |
| 2,060,495 | 11/1936 | Giragosian | 473/40 |
| 2,469,652 | 5/1949 | Jones | 473/40 |
| 4,103,773 | 8/1978 | Haber | 473/41 |
| 4,452,450 | 6/1984 | Glayton | 473/40 |
| 4,469,328 | 9/1984 | Pacitti | 473/40 |
| 4,644,630 | 2/1987 | Blum | 273/72 |

*Primary Examiner*—Theatrice Brown
*Attorney, Agent, or Firm*—Foley & Lardner

[57] ABSTRACT

A billiards ball rack for displaying information and for assisting a user in racking billiards balls on a billiards table is disclosed. The billiards ball rack preferably includes a bottle cap shaped shell having a circular outer wall with a plurality of ridges. A display wall extends inwardly from the outer wall and terminates in a ball rack portion. The ball rack portion includes side walls arranged in an appropriate configuration to rack the billiards balls prior to initiating the game.

15 Claims, 2 Drawing Sheets

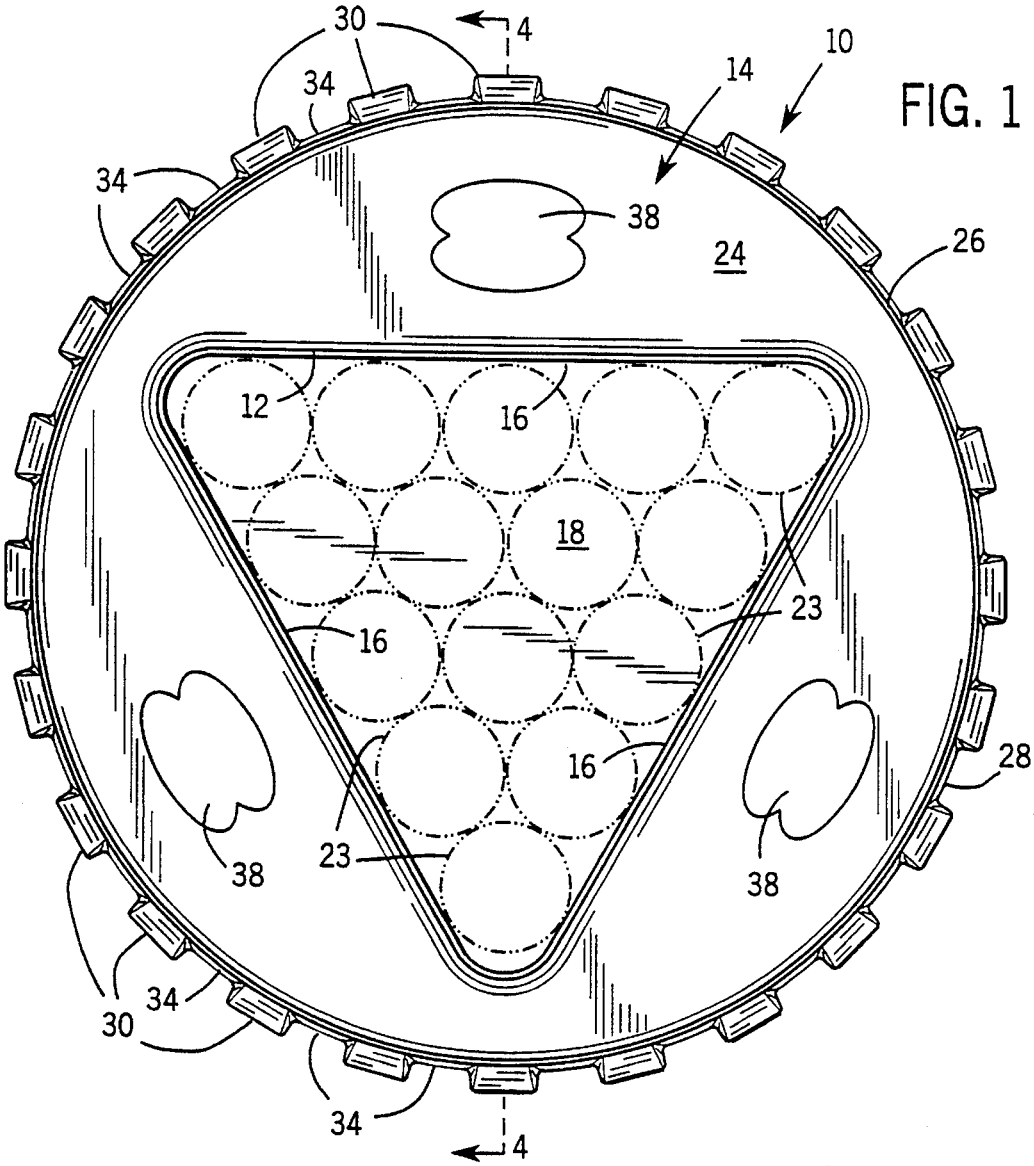
FIG. 1
FIG. 2
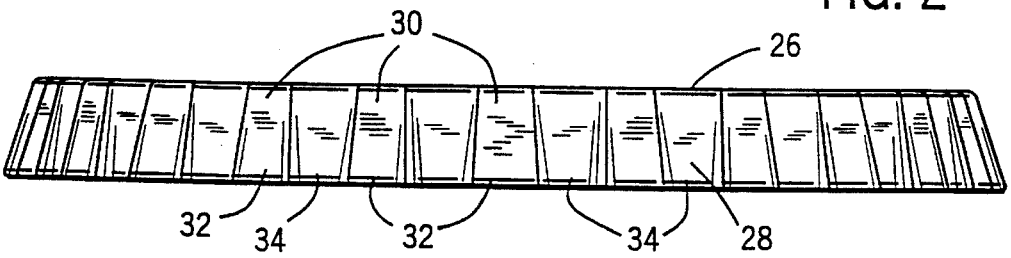

BILLIARD BALL RACK INCORPORATING A DISPLAY AREA

FIELD OF THE INVENTION

The present invention relates generally to a ball rack for racking billiards balls, and particularly to a ball rack that incorporates a display area for advertising or otherwise displaying information.

BACKGROUND OF THE INVENTION

Many billiards games, such as pool, require racking of the balls prior to initiating the game. In some of those games the billiards balls are placed in a triangular arrangement at the beginning of the game, and billiards ball racks are used to facilitate placement of the balls. Accordingly, the standard ball rack includes three walls each having a bottom edge and a top edge. The walls are arranged to form the outer boundary of the starting configuration of the billiards balls.

Thus, the bottom edge of the rack is placed on the billiards table, and the balls are placed between the side walls until the inner area defined by the side walls is filled. At this point, the ball rack may be lifted from the billiards table leaving the balls arranged in the desired starting configuration. Some ball racks include a lip disposed along the top edge to help a player lift the ball rack from the billiards table after the balls have been appropriately placed.

After removal from the billiards table, the ball rack is typically stored during the playing of the game. For example, the racks are often hung along a wall of the billiards room. This can be unsightly, and at a minimum, the ball racks serve no purpose while stored during or between games. Particularly in public billiards rooms, it would be advantageous to incorporate a display with the ball rack to provide instructions, advertising, or decoration.

SUMMARY OF THE INVENTION

The present invention relates generally to a billiards ball rack for displaying information and for assisting a user in racking billiards balls on a billiards table. The billiards ball rack comprises a rack portion having three side walls preferably forming a triangular aperture through which the billiard balls may pass when placed on the billiards table. The ball rack also includes a display area that may be integrally formed with the rack portion. The display area includes a display wall extending generally transversely and outwardly from the three side walls. The display area includes an outer edge configured to facilitate gripping by the user.

According to additional aspects of the invention, an outer wall having a plurality of gripping ridges extends generally transversely to the display wall in the same general direction as the three side walls. The display wall, outer wall, and ridges may be formed in the general configuration of a bottle cap. According to a further aspect of the invention, a display, such as a recessed design, attached decal, painted surface, or integrally formed protruding design, may be disposed on the display wall.

BRIEF DESCRIPTION OF THE DRAWINGS

The invention will hereafter be described with reference to the accompanying drawings, wherein like reference numerals denote like elements, and:

FIG. 1 is a top plan view of a billiards ball rack according to a preferred embodiment of the present invention;

FIG. 2 is a side view of the billiards ball rack illustrated in FIG. 1;

DETAILED DESCRIPTION OF THE PREFERRED EMBODIMENT

Figure 3:
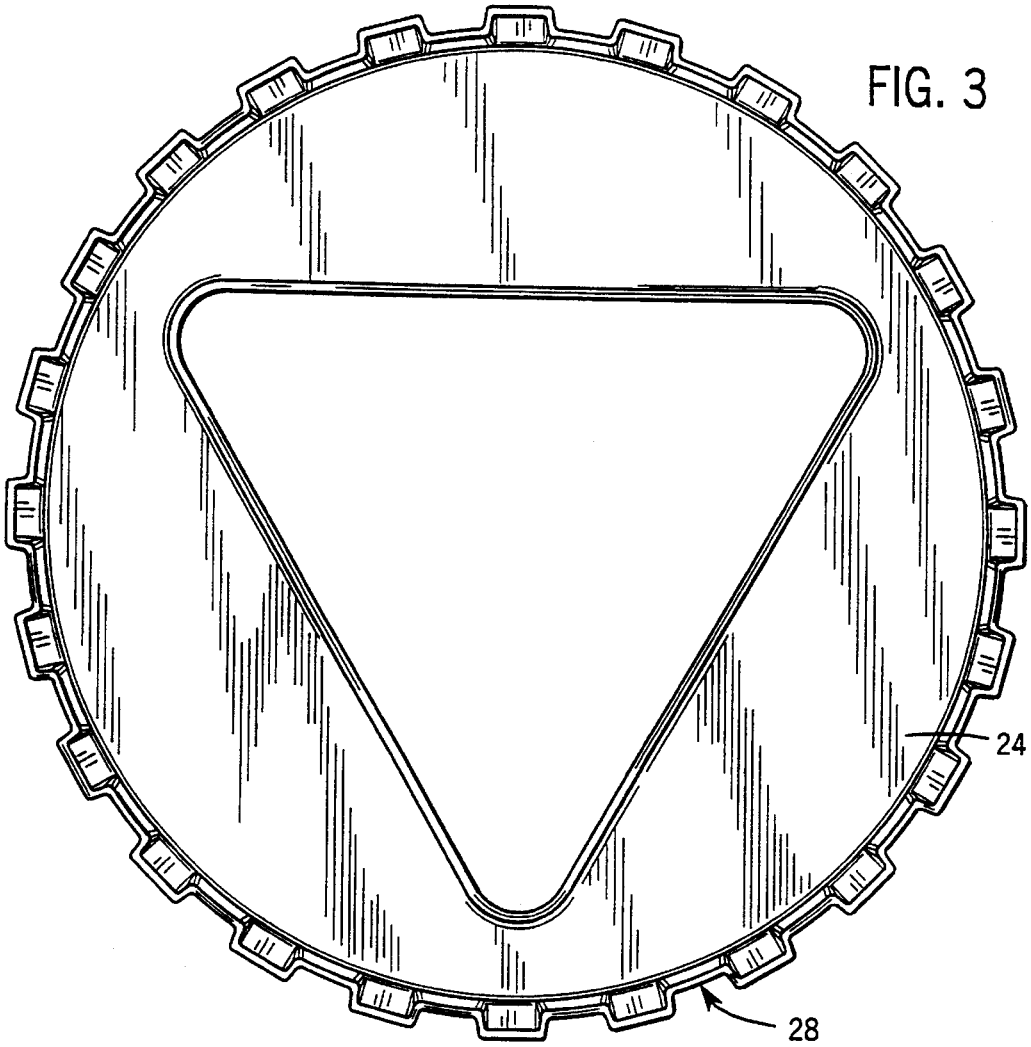
FIG. 3 is a bottom view of the billiards ball rack illustrated in FIG. 1.
Figure 4:
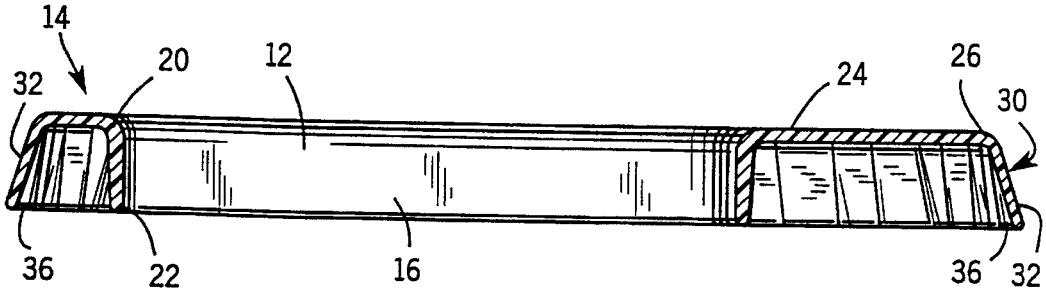
FIG. 4 is a cross sectional view taken generally along line 4—4 of FIG. 1.

Referring generally to FIGS. 1–4, a billiards ball rack 10 according to a preferred form of the invention is illustrated. Billiards ball rack 10 is designed to display information and to assist a user in racking billiards balls on a billiards table. Billiards ball rack 10 includes a rack portion 12 and a display region 14.

Rack portion 12 includes a plurality of side walls 16, and preferably there are three side walls arranged in a generally triangular configuration. As illustrated, the three side walls may be connected to form an aperture 18 through which the billiards balls may pass. Each of the side walls includes a top edge 20 and bottom edge 22. When billiards ball rack 10 is placed on a billiards table, bottom edge 22 is disposed towards the surface of the billiards table. The billiards balls, denoted by reference numeral 23 in FIG. 1, may be placed in aperture 18 and the side walls 16 force the billiards balls into a particular configuration dictated by the rules of the particular game being played. Once the balls are arranged in the desired configuration, ball rack 10 is lifted from the table, allowing the billiards balls to pass therethrough and remain resting on the surface of the table in the desired configuration.

Display region 14 includes a display wall 24 that extends generally transversely and outwardly from the side walls 16. Preferably, display wall 24 extends outwardly substantially from top edge 20 of rack portion 12 and includes an outer edge 26 that may be gripped by a user. Outer edge 26 may have a variety of shapes, but it is preferably circular.

In the illustrated embodiment, an outer wall 28 extends from outer edge 26 generally transverse to display wall 24. Side wall 16 and outer wall 28 extend from display wall 24 in generally the same direction, for instance, a downward direction when billiards ball rack 10 rests on the surface of a billiards table.

Outer wall 28 may include a plurality of ridges 30. Ridges 30 can be formed in a variety of configurations, but preferably each ridge includes an outer panel 32 connected to outer edge 26 at one end. Each outer panel 32 extends downwardly and outwardly from outer edge 26 when billiards ball rack 10 is resting on the surface of a billiards table. (See FIG. 4 which illustrates the general downward and outward orientation of each panel 32.)

Outer wall 28 further includes a plurality of intermediate panels 34 disposed between consecutive outer panels 32 in the circumferential direction. Intermediate panels 34 are disposed at a different angle than outer panels 32 and may be disposed generally perpendicular to display wall 24. Each outer panel 32 is preferably connected to the adjacent intermediate panels by a pair of side panels 36 that are generally triangular in shape. (See FIG. 4) In the preferred embodiment, display wall 24 and outer wall 28, including its plurality of ridges, are arranged to form a bottle cap shaped shell. In other words, the outward appearance of display region 14 is similar to an enlarged bottle cap, such as those found on beer bottles.

A display 38 may be disposed on display wall 24 in a variety of forms. For example, display 38 may include designs, logos, advertisements, instructions, arrangements of lights, stereoscopic displays, or any of a variety of decorative or information conveying items. Additionally, display 38 may be recessed into or formed through display wall 24. The display may be painted or printed to display wall 24 or it may be affixed to display wall 24 in the form of decals or other attachments. Additionally, display 38 may be integrally formed with the display wall and may be at least partially recessed or partially protruding therefrom in a single display or a plurality of displays.

Billiards ball rack 10 can be created from a wide variety of uniform materials or from combinations of materials. However, rack portion 12 and display region 14 are preferably integrally molded from an injection moldable plastic, such as ABS plastic.

It will be understood that the foregoing description is of a preferred exemplary embodiment of this invention and that the invention is not limited to the specific form shown. For example, the display region may be formed with or without an outer wall, the outer wall can have a smooth surface or ridges formed in a variety of configurations, various materials, such as plastics, wood, or paper board, may be used in the construction of the ball rack. Additionally, various combinations of materials can be used to construct the device. These and other modifications may be made in the design and arrangement of the elements without departing from the scope of the invention as expressed in the appended claims.

What is claimed is:

1. A billiards ball rack for displaying information and for assisting a user in racking billiard balls on a billiards table, comprising:

a rack portion having three side walls forming a triangular aperture through which the billiard balls may pass;

a display region integrally formed with the rack portion, the display region including a display wall extending generally transversely and outwardly from the three side walls, the display region including an outer edge configured to facilitate gripping by the user, and an outer wall extending generally transversely from the display wall, wherein the three side walls and the outer wall extend from the same side of the display wall, the outer wall including a plurality of ridges to facilitate grasping of the billiard ball rack by the user.

2. The billiards ball rack as recited in claim 1, wherein the outer edge is generally circular in shape.

3. The billiards ball rack as recited in claim 2, further comprising a display disposed on the display region.

4. The billiards ball rack as recited in claim 3, wherein the display is recessed into the display wall.

5. The billiards ball rack as recited in claim 3, wherein the display at least partially protrudes from the display wall.

6. The billiards ball rack as recited in claim 3, wherein the display is affixed to the display wall.

7. The billiards ball rack as recited in claim 3, wherein the side walls, the display wall and the outer wall are integrally molded from injection moldable plastic.

8. The billiards ball rack as recited in claim 2, further comprising a plurality of displays.

9. A billiards ball rack for displaying information and for assisting a user in racking billiard balls on a billiards table, comprising a shell including a circular outer wall having a top edge, a bottom edge, and a plurality of ridges therebetween, and a display wall extending inwardly from the top edge and generally transversely to the outer wall; and a ball rack integrally formed with said shell, the ball rack including at least three side walls extending generally transversely to the display wall substantially in the same direction as the circular outer wall.

10. The billiards ball rack as recited in claim 9, wherein the three side walls are arranged in a triangular shape.

11. The billiards ball rack as recited in claim 10, further comprising a display disposed on the display wall.

12. The billiards ball rack as recited in claim 11, wherein the display is recessed into the display wall.

13. The billiards ball rack as recited in claim 11, wherein the display is integrally formed with the side wall.

14. The billiards ball rack as recited in claim 11, wherein the display is attached to the display wall.

15. The billiards ball rack as recited in claim 11, wherein the outer wall, the display wall and the three side walls are integrally molded from an injection moldable plastic.

* * * * *